United States Patent [19]

Cornwall

[11] 4,136,460

[45] Jan. 30, 1979

[54] ADJUSTABLE BUTTONHOLE SEWING GUIDE

[76] Inventor: Della E. Cornwall, 5065 S. Gurene Dr., Salt Lake City, Utah 84117

[21] Appl. No.: 779,283

[22] Filed: Mar. 21, 1977

[51] Int. Cl.[2] ..... A41H 25/00

[52] U.S. Cl. ..... 33/190

[58] Field of Search ..... 33/190, 174 G; 112/65, 112/136

[56] References Cited

U.S. PATENT DOCUMENTS

| | | | |
|---|---|---|---|
| 212,353 | 2/1879 | Card | 33/174 G |
| 353,064 | 11/1886 | Huffer | 33/190 |
| 959,639 | 5/1910 | Stanton | 33/190 |
| 2,741,852 | 4/1956 | Berardinelli | 33/190 |
| 2,814,126 | 11/1957 | Berardinelli | 33/190 |
| 2,824,530 | 2/1958 | Katz | 33/190 X |
| 3,500,550 | 3/1970 | Mihai | 33/190 |

*Primary Examiner*—Charles E. Phillips
*Attorney, Agent, or Firm*—James R. Young

[57] ABSTRACT

An adjustable buttonhole sewing guide includes a template preferably in the form of a thin, flexible fabric having rectangular holes therethrough for guiding a seamstress in sewing buttonholes in garments. The holes are in predetermined sizes, orientation, and spacing. Portions of the guide also have appropriately shaped corresponding guide edges which can be separated from the template and used as overlays on the template to adjust the size of the holes for sewing buttonholes of desired size. The template and overlay can be temporarily attached together to maintain the desired size of the holes in the guide and placed upon the fabric onto which the buttonholes are to be sewn. The combination of the fabric, template and overlay can then be moved into position under the foot of a sewing machine, and, by using the appropriate zig-zag stitches, the buttonholes can be sewn within the confines of the preset guide holes in the template with resulting uniformity of size, spacing, and orientation of the buttonholes in the material or garment. The guide includes several distinct combinations of sizes, spacing, and orientations of buttonholes for common, practical application.

11 Claims, 9 Drawing Figures

ADJUSTABLE BUTTONHOLE SEWING GUIDE

BACKGROUND OF THE INVENTION

The present invention relates generally to buttonhole sewing apparatus and more particularly to buttonhole template guides for establishing uniformity in size, spacing and orientation of buttonholes to be sewn onto garments.

Buttonholes have been an integral part of wearing apparel and fashion for decades both for functional fastening applications and for ornamental or decorative applications. In the most common form, a buttonhole comprises a slit in the material through which buttons can be passed from one side of the material to the other, and they are usually characterized by threaded stitching around the perimeter of the slit to inhibit fraying and tearing of the fabric. Even though the principle and form of a buttonhole is quite simple, the stitching is quite difficult to sew uniformly in size, orientation, and overall appearance.

Hand-stitched buttonholes, such as that disclosed in U.S. Pat. No. 225,381 issued to J. House are certainly functional, but they are very difficult to sew in a neat, uniform manner as well as being extremely time consuming. Industry has developed sophisticated buttonhole stitching machinery for mass production application; however, the amateur seamstress does not have access to such expensive, sophisticated equipment. Several more inexpensive innovations have been made to relieve the amateur seamstress from the tedious and difficult hand-stitching process for making buttonholes, such as, the buttonholing attachment for straight stitch sewing machines which have gained some popularity during the past twenty years. U.S. Pat. No. 2,885,981, issued to Dressler et al is typical of these attachments. These developments were certainly an improvement, and by setting up one's own guideline system on a machine, a seamstress or tailor could approximate the distance from the edge of the garment and set the buttonholes square with the edge. But unless one becomes extremely proficient, it is not uncommon for several buttonholes in a series to be placed slightly out of alignment or unevenly spaced.

The most recent innovation has been the development of the so-called "zig-zag" sewing machines having a plurality of cams built in as integral components of the sewing machine for producing a variety of zig-zag stitches which can be conveniently selected respectively by external controls on the sewing machine. A seamstress can use a combination of zig-zag stitches available on these sewing machines to produce a more professional looking buttonhole stitch, and the flexibility in size and bite is very convenient. U.S. Pat. No. 2,977,913, issued to E. Schenkengel illustrates a typical buttonhole stitched with a zig-zag sewing machine. It includes a bar tack at each end stitched with a larger zig-zag movement having very little forward travel and sideline stitches on each side of the buttonhole sewn with smaller zig-zag stitches having greater forward travel. Nevertheless, even after painstaking effort of measuring, basting, pinning, taping or penciling guidelines, it is quite difficult for a series of buttonholes to be sewn with consistent size, orientation, and appearance.

SUMMARY OF THE INVENTION

Accordingly, it is an object of the present invention to provide a new and improved buttonhole sewing guide for use in combination with sewing machines to position a series of buttonholes uniformly on a garment and to provide an adjustable border within which to stitch the buttonhole with the sewing machine.

It is another object of the present invention to provide a thin, flexible template having a rectangular hole therethrough of a size large enough to accommodate a variety of buttonholes for placement on the garment where the buttonhole is to be sewn and size adjustment means for reducing the effective size of said hole to correspond with the desired size of the particular buttonhole stitching to be sewn.

It is a further object of the present invention to provide a combination of predetermined sized and oriented buttonhole sewing guides on a single sheet, each guide including a template with holes therethrough and guide portions separable from the template and superimposed thereon to uniformly reduce the effective size of the holes to a desired buttonhole stitch size and which are inexpensive to manufacture and are reusable by the seamstress.

A still further object of the present invention is to provide a method of stitching buttonholes by use of an adjustable guide for quick, uniform positioning and stitching of a series of buttonholes in a garment.

The present invention is directed to a novel apparatus and method for positioning and guiding the sewing of buttonholes with a sewing machine preferably of the "zig-zag" type having integrally built in zig-zag cams or having an appropriate zig-zag attachment, including a template with holes therethrough of predetermined size and spacing and a guide portion or overlay with appropriate corresponding edges thereon to uniformly reduce the size of said holes to the desired size of the buttonholes to be sewn. The buttonhole guide which includes the template and the overlay can comprise a single sheet of fabric which can be separated or cut into the component parts of the template and overlay prior to use. The overlays in this invention include a straight guide edge for reducing a single dimension of the holes in the template, corresponding rectangular holes in an overlay for placing over the template for reducing two dimensions of the holes, open-sided rectangular holes for placing over the rectangular holes in the template for reducing two dimensions, and triangular notches for overlaying holes in the template oriented at an angle to the garment edge to reduce the size of the holes in two dimensions.

The template and overlay preferably are fabricated of a thin, flexible fabric which can be placed on the garment and pinned thereto for handling and manipulating in a unitary manner while sewing the buttonholes with a zig-zag sewing machine. To accurately place and sew a series of buttonholes on the garment, the seamstress needs to determine only two criteria: the length of the buttonhole required for the button to be used on the garment, and the required location of at least one button. By placing one of the guide holes over that location and orienting the template parallel to the edge of the garment, the remaining buttonholes in the series can be quickly sewn within the confines of the remaining guide holes in the template to produce uniform placement, orientation, and appearance of the finished buttonholes. When all of the buttonholes in a series are sewn, the template and overlay can be removed from the garment and saved for reuse on another occasion.

The fabric of the guides can be comprised of two layers laminated together, the layer on one side being of a relatively dark color and the fabric on the opposite side being of a relatively light color so that a substantially contrasting color is available for use on the garment, regardless of the color of the garment, for conducive sight conditions.

BRIEF DESCRIPTION ON OF THE DRAWINGS

Other objects, advantages and capabilities of the present invention will become more apparent as the description proceeds, taken in conjunction with the accompanying drawings, in which.

Figure 9:
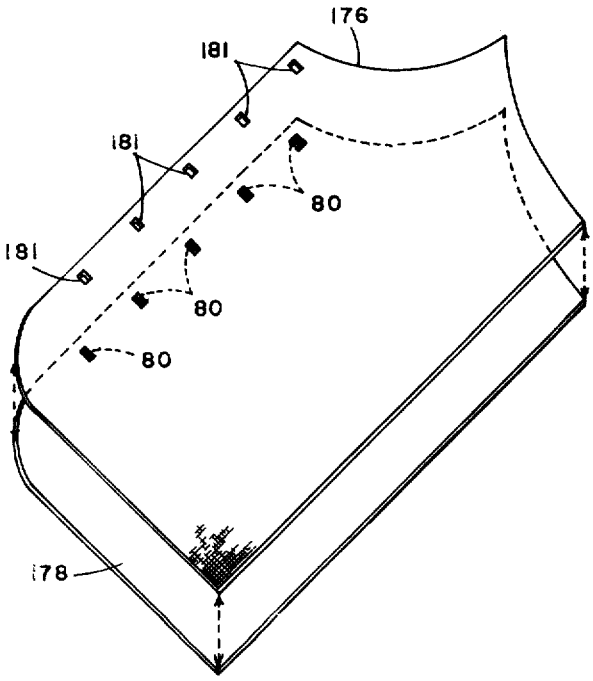
Figure 8:
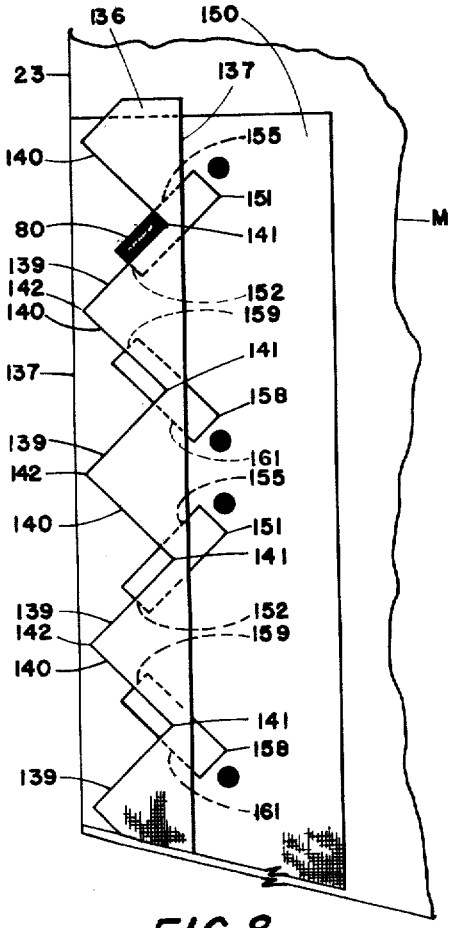

FIG. 8 is an enlarged section of a template having a series of holes therethrough, each hole being oriented at oppositely directed 45° angles to the edge of the template and having triangular notched overlay for receiving two dimensions of the holes; and FIG. 9 is a perspective view of a third alternate embodiment having a template in a configuration with its perimeter corresponding to the perimeter of the section of the garment on which the buttonholes are to be sewn.

DETAILED DESCRIPTION OF THE PREFERRED EMBODIMENT

Figure 1:
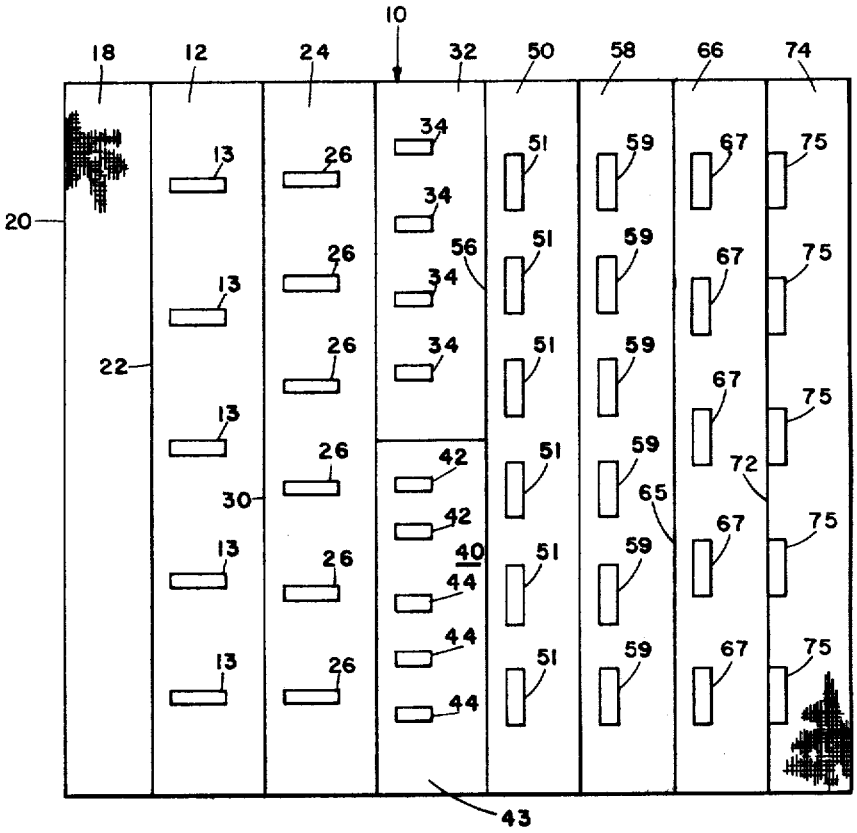
FIG. 1 is a plan view of the preferred form of a buttonhole sewing guide having several combinations of buttonhole sizes, orientations, and spacing as well as corresponding overlay portions for each.

The preferred embodiment composite buttonhole sewing guide 10 of the present invention, as shown in FIG. 1, is in the form of a rectangular sheet of thin, flexible fabric divided by lines thereon into a plurality of adjacent elongated rectangular columns comprising the templates and corresponding overlay portions. The columns 12, 24, 32, 40, 50 and 66 are distinct, individual templates having rectangular holes therethrough, and the columns 18, 58, and 74 are overlays having guide edges for superimposing on corresponding templates to reduce the effective opening sizes or internal perimeters of the holes through which buttonholes can be stitched into a fabric garment, as will be described in more detail herein.

Even though only one template and one corresponding overlay are used together in combination at any particular time, it has been found convenient to include several varying templates and overlays useful for different applications on one sheet of rectangular fabric comprising the composite buttonhole sewing guide 10 for initial fabrication and merchandising. Consequently, the individual templates 12, 24, 32, 40, 50 and 66 and the individual overlays 18, 58, and 74 must be separated from each other such as by cutting apart with scissors prior to use.

The composite buttonhole sewing guide 10 shown in FIG. 1 includes four templates 12, 24, 32, and 40 having rectangular holes therethrough oriented with their longitudinal axes perpendicular to the longitudinal axes of the respective templates adapted for use in sewing horizontally oriented buttonholes on garments as they are to be worn by persons standing erect, and it includes two templates 50 and 66 having rectangular holes therethrough oriented with their longitudinal axes parallel to the longitudinal axes of the respective templates adapted for use in sewing vertically oriented buttonholes on garments as they are to be worn by persons standing erect. For convenience, those template holes adapted for use in sewing horizontally oriented buttonholes on garments will be referred to herein as horizontal holes, and those template holes adapted for use in sewing vertically oriented buttonholes on garments will be referred to herein as vertical holes. For example, template 12 includes five rectangular horizontal holes 13, each being spaced equidistant from adjacent holes on the template 12. Template 24 includes six rectangular horizontal holes 26, each being spaced equidistant from adjacent holes on the template 24, and the distance between adjacent holes 26 being somewhat smaller than the distance between adjacent holes 13 on template 12. Template 32 also includes rectangular horizontal holes 34 which are smaller in size and equidistantly spaced still closer together than the holes 26 on template 24. Template 40 includes two sets of rectangular horizontal holes 42, 44, respectively. The three horizontal holes 44 are equidistantly spaced even closer together than holes 34 on template 32, and the two horizontal holes 42 are spaced still closer together than holes 44.

Having this variation in the size and spacing of the holes in different templates, one can select the template particularly suited for the garment to be sewn. For example, template 12 might be appropriate for larger garments such as coats, template 24 may be appropriate for shirts, template 32 may be appropriate for children's clothes, and templates 40 and 43 may be particularly suitable for cuffs.

Figure 2:
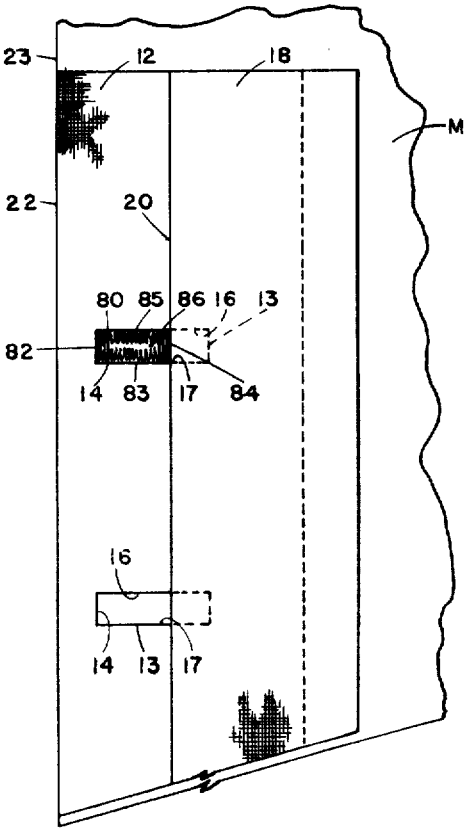
FIG. 2 is an enlarged section of a template with a straight edge overlay for horizontal buttonholes in position on a portion of the garment with one buttonhole being shown stitched thereto.

The overlay 18 of the composite buttonhole sewing guide 10 in FIG. 1 is in the form of an elongated rectangle positioned adjacent template 12 and is adapted for use in combination with any of the templates 12, 24, 32, and 40 described above having horizontal holes. For example, if a person desires to use template 12, overlay 18 must be separated from template 12 by cutting along border edge or cut line 22, and template 12 must be separated from template 24 by cutting along cut line 30. The overlay 18 is then positioned over template 12 with its straight guide edge 20 partially superimposed over the right portion of the holes 13, as shown in FIG. 2. Since this overlay 18 is only effective to reduce the size of holes 13 by one dimension along the longitudinal axis of the hole, the overlay 18 is positioned on template 12 with its straight edge 20 parallel to the left edge 22 of template 12 leaving sufficient space between the front edge 14 of the hole and the straight guide edge 20 of the overlay to correspond with the length of the buttonhole 80 to be sewn. The length of the buttonhole 80 to be sewn and thus the length of the guide hole in the template will be determined by the size of the button to be placed on the garment.

When the overlay 18 is positioned on the template 12 as just described, all of the holes 13 can be uniformly reduced in longitudinal dimension. The overlay 18 is then pinned in this position on template 12 so that they cannot move relative to each other during use.

The individual buttonhole guide now comprised of template 12 and overlay 18 is then positioned on the garment material M such that the holes are positioned on the locations where horizontally oriented buttonholes are desired to be sewn in the garment. Usually there is one critical location for at least one buttonhole, such as directly under a lapel of the garment, throat, or bustline.

Preferably, the space between the front edge 14 of the hole 13 and the edge 22 of the template 12 will correspond to a standard spacing between the front edge of the buttonhole 80 and the edge 23 of the garment material M. If so, the guide is easily positioned on the garment with the front edge 22 of the template corresponding to the edge 23 of the garment material as shown in FIG. 2. If different spacing is required, the guide can be moved left or right the required distance while maintaining the front edge 22 of the template 12 parallel to the edge 23 of the garment material. When the guide is thus positioned as desired, it can be temporarily fastened to the garment material such as with pins or tack stitching to hold the guide and the material of the garment in immovable relation to each other during the sewing operation.

The garment material M with the template 12 and overlay 18 positioned thereon is then placed in the sewing machine and the buttonhole 80 is sewn in the garment by stitching the front bar tack 82 adjacent the front edge 14, then the first side stitch 83 adjacent to the bottom side 17 is sewn, the rear bar tack 84 is sewn adjacent the edge 20 of the overlay, and finally a second side stitch 85 is sewn adjacent the top side 16. Once the first buttonhole 83 is thus sewn in the first hole 13, the procedure is repeated in remaining holes 13 until the desired number of buttonholes are sewn.

If more than five buttonholes are required on the garment, the template 12 can be removed from the garment material M after the fifth buttonhole is sewn and repositioned with the fifth buttonhole aligned within the first hole 13 in the template 12, again maintaining the front edge 22 of the template in alignment with the edge 23 of the garment. Buttonholes can then be sewn in the remaining holes 13 and this second set of buttonholes will be in proper spacing and alignment with the first set of buttonholes sewn with the template 12 in the first position.

The overlay 18, of course, can be used with equal facility on each of the templates 12, 24, 32, and 40 in the same manner as described for use on template 12.

When vertically oriented buttonholes are required on a garment, one can use either template 50 or template 66, each of which has vertical holes therethrough as defined and described above. As shown in FIG. 1, template 50 includes six rectangular vertical holes 51, each of which is spaced apart an equal distance from adjacent holes 51 on template 50. Template 66 is similar to template 50, but it has five rectangular vertical holes 67 therethrough, each of which is spaced equidistant from adjacent holes 67 in template 66 and the spacing between holes 67 in template 66 is somewhat smaller than the spacing between holes 51 in template 50.

Figure 3:
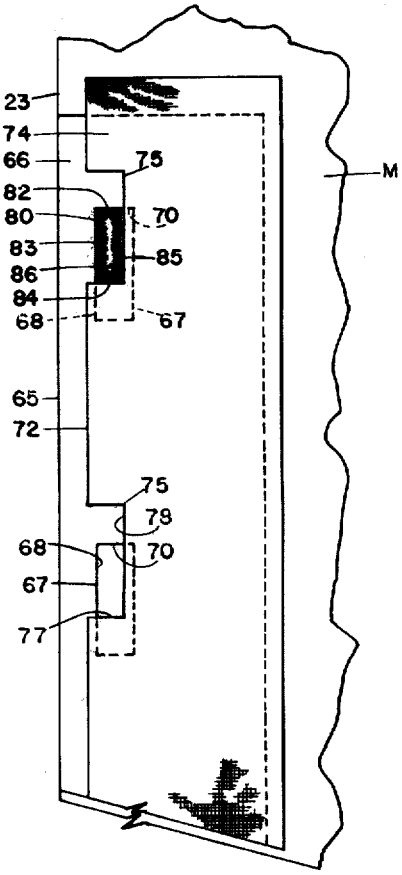
FIG. 3 is an enlarged section of a template having vertical holes with an overlay having open-sided guide holes for reducing two dimensions of the template holes.

The embodiment shown in FIG. 1 also includes two variations of overlays for use in combination with the templates with vertical holes. Overlay 58 is adapted for use in combination with template 50 and is in the shape of an elongated rectangle having rectangular holes or openings 59 therein of equal size, orientation and spacing as the holes 51 in template 50. Overlay 74 is adapted for use in combination with template 66 and is also in the shape of an elongated rectangle having recangular openings 75 therein of equal size, orientation, and spacing as the holes 67 in template 66; however, the left sides of openings 75 are aligned with the border line or cut line 72 between template 66 and overlay 74. Consequently, when template 66 and overlay 74 are separated or cut apart at 72 for use, the holes 75 are open sided as shown in FIG. 3. It should be understood that the respective configurations of these overlay variations 58, 74 are not limited to use with the particular corresponding templates 50, 66 as described herein since the only substantive difference in the templates 50, 66 is the spacing between adjacent holes of each template.

The illustration in FIG. 3 shows the preferred manner of using template 66 in combination with overlay 74 as a guide for sewing vertical buttonholes on garment material M. Overlay 74 is first positioned on template 66 with the open-sided holes 75 in the overlay 74 in offset relation to the holes 67 in template 66 to reduce the size of holes 67 the desired amount in both longitudinal and transverse dimensions. As shown in FIG. 3, the hole 75 is offset upwardly and to the left of the hole 67 in template 66, thereby leaving an effective guide opening defined by the front and top edges 68, 70 of hole 67 and the bottom and inside edges 77, 78 of hole 75. The effective size of the guide opening will of course be determined by the size of the button and corresponding buttonhole required on the garment.

If the front edge 72 of the overlay 74 is maintained in parallel relation to the front edge 65 of template 66, all of the holes 67 will be reduced in size uniformly throughout the length of the template. The template 66 and overlay 74 can then be temporarily fastened together such as with pins or tack stitching and they can then be positioned as an individual unitary guide on the garment material M, preferably with the front edge 65 of template 66 in alignment with the edge 23 of the garment material M and temporarily fastened thereto to prevent movement of the guide in relation to the material M as the buttonholes are being sewn. The material M and guide are then placed in the sewing machine for sewing the vertical buttonholes.

Figure 5:
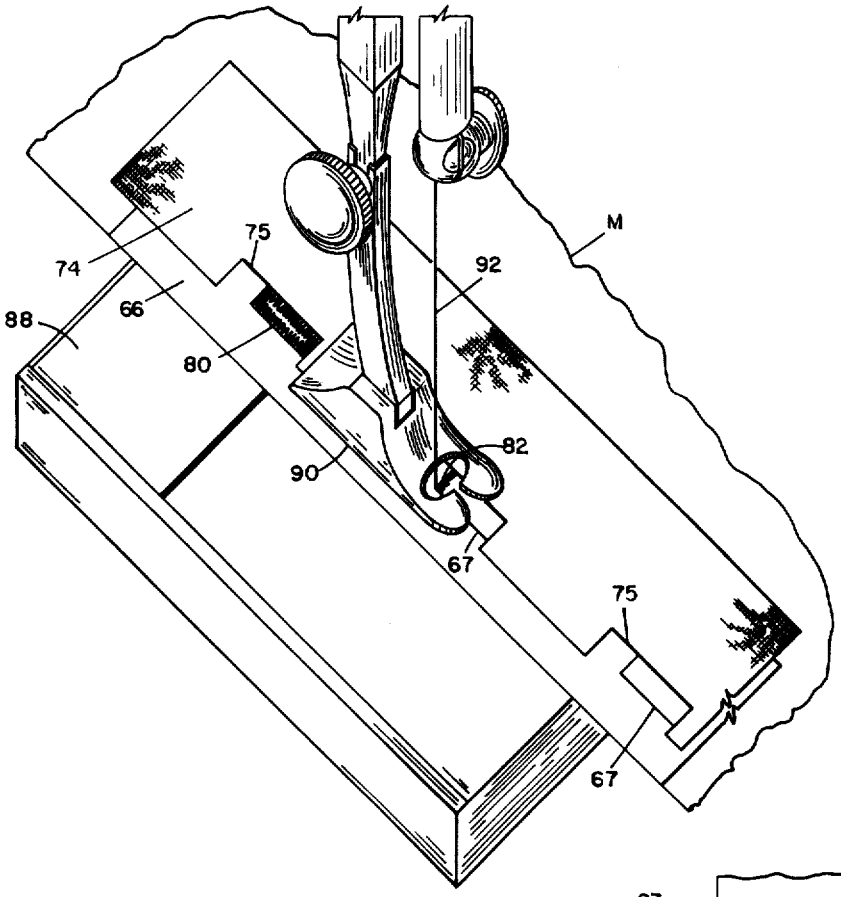
FIG. 5 is a perspective view of the foot and needle of a sewing machine stitching a series of buttonholes in a garment utilizing the template with vertical holes and an overlay with open-sided guides.

As shown in FIG. 5, the material M is placed on the platform 88 of the sewing machine S under the foot 90. As further illustrated in FIG. 3, the buttonholes 80 are then sewn within the border of the guide opening of hole 67 with the needle 92 by first sewing the front bar tack 82 adjacent to the top edge 70, then proceeding to sew the first side stitch 83 along the front edge 68 of hole 67, then sewing a rear bar tack 84 adjacent the bottom edge 77 of hole 75, and finally returning along the inside edge 78 of hole 75 with the second side stitch to close the buttonhole. This operation is quite simple when done with a "zig-zag" sewing machine having the appropriate cams for the required zig-zag stitches built integrally therein with convenient controls for switching from one zig-zag stitch to the next; however, it can also be performed with sewing machines having zig-zag attachments with similar capabilities.

When the first buttonhole 80 is thus completed, the material M and guide is then moved so that the second hole 67 of the guide is positioned under needle 92 and the second buttonhole is sewn in a similar manner. The remaining buttonholes are also sewn in a similar manner.

Figure 4:
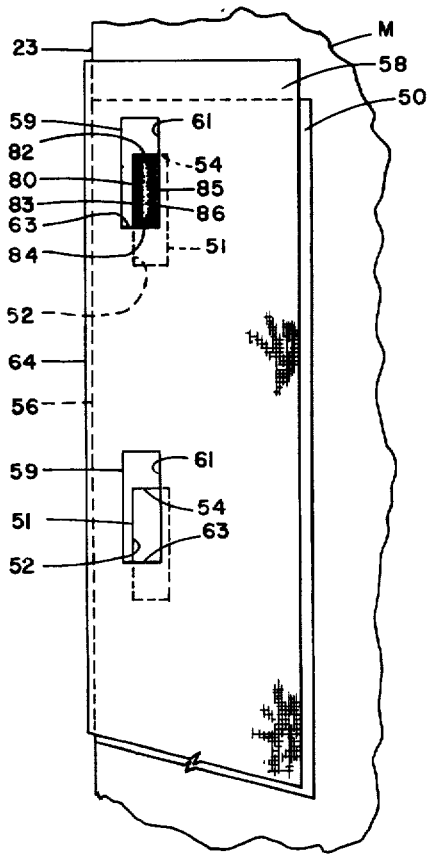
FIG. 4 is an enlarged section of a template having vertical buttonholes and an overlay having correspondingly sized and shaped rectangular holes therethrough for reducing two dimensions of the template holes.

In the other variation, the overlay 58 includes a series of holes 59 of corresponding size and spacing to the holes 51 in template 50. The use and positioning of this variation is shown in FIG. 4 wherein it can be seen that the overlay 58 is used to reduce the size of holes 51 in template 50 in a similar manner to that described for the use of overlay 74 in combination with template 66, the only difference being the holes 59 in overlay 58 do not have an open side as do the holes 75 in template 74. The overlay 58 is positioned with its holes 59 in offset relation, here shown upwardly and to the right, to the hole 51 in template 50. The effective opening of holes 51 is therefore uniformly reduced to the area between the front and top edges 52, 54 of holes 51 and the back and bottom edges 61, 63 of holes 59. Again, the overlay 58 and template 50 are temporarily fastened together and positioned on the garment material M with the front edge 56 of template 50 in alignment with the edge 23 of the material M. The buttonholes are then sewn with a sewing machine S within the boundaries of the effective opening in the manner already described.

Of course overlay 58 can also be used to reduce the size of holes 51 in only one direction if so desired by merely shifting the overlay 58 so that it covers only an end or only one side of the hole 51. Such reduction in size is only one dimension if desired. For example, where the width of hole 51 corresponds to the width of the buttonhole to be sewn.

In order to reduce costs, the composite buttonhole sewing guide 10 can be simply fabricated of a sheet of fabric with the cut lines and the outlines for the holes imprinted on the surface. The individual overlay and template portions can then be separated from each other by cutting along the respective borders or cut lines and the holes can be cut out with scissors or a razor blade. Alternatively, the guide 10 could be fabricated with the holes prepunched or with the templates and overlays pre-separated or manufactured in elongated strips and sold on rolls.

For purposes of explanation and not limitation, it is convenient to size hole 13 in template 12 one and one-half inches long and one-fourth inch wide and spaced three and one-half inches apart. The front edge 14 of the hole 13 is spaced one-half inch from the edge 22 of the template 12. Template 24 also has holes 26 sized one and one-half inches long and one-fourth inch wide spaced one-half inch from the edge 30. The spacing between holes 26 and template 24 is two and three-fourths inches.

The holes in template 32 are one inch long and one-fourth inch wide, spaced one-half inch from the edge 38 and have the distance therebetween of two and one-fourth inches. The template 40 has two holes 42 spaced one and one-fourth inches apart, and template 43 has three holes spaced one and one-half inches apart. The holes 51 in template 50 are spaced two and one-fourth inches apart, and the vertical holes 67 in template 66 are spaced three and one-half inches apart. Holes 51 and 67 are both one and one-half inches long and one-half inch wide.

Although the description herein has described the overlay portions as being appropriately positioned over or superimposed on the respective template portions they could also be positioned under the template portions with equal effectiveness to reduce the dimensions of the holes in the templates to obtain guide holes of desired size for sewing buttonholes.

Figure 6:
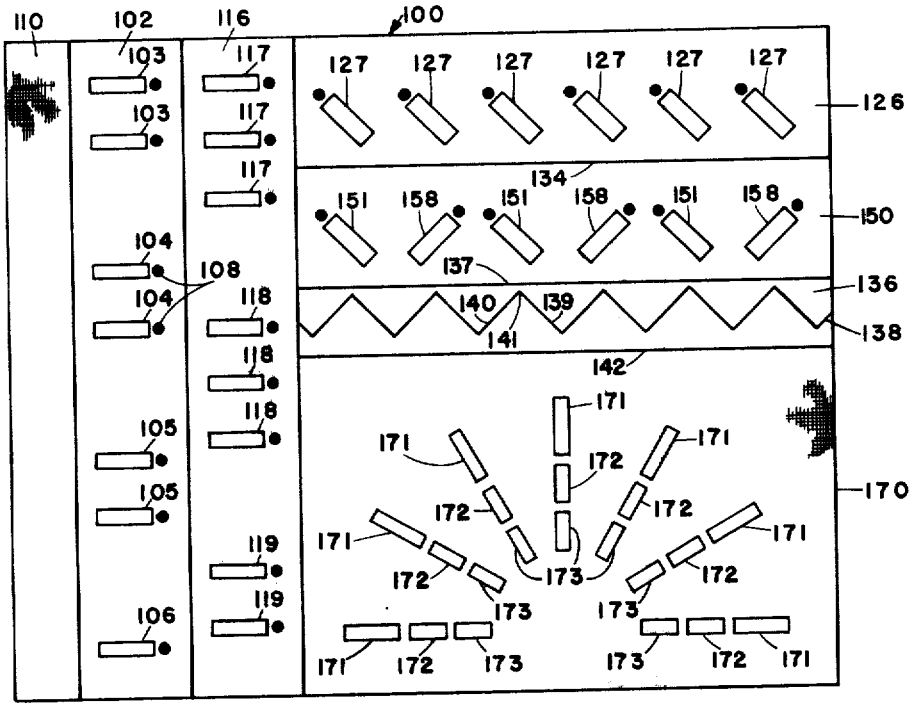
FIG. 6 is a plan view of an alternate embodiment of the buttonhole sewing guide.

The guide 100 shown in FIG. 6 is an alternate embodiment having different variations of buttonhole configurations for specialized uses. The templates 102 and 116 include rectangular horizontal holes grouped in sets of two or three. The overlay 110 is adapted for use with either template 102 or 116 in a manner similar to that described above for the use of overlay 18 in combination with template 12 for reducing the longitudinal dimension of the holes. The template 102 has three sets of holes 103, 104, 105 spaced in groups of two and an additional hole 106 with a space between it and the adjacent hole 105 equal to the distance between adjacent holes 103, 104 and 104, 105, respectively. If the series of buttonholes required for the garment includes more than three sets of holes, the template 102 can be repositioned with the hole 106 aligned with the last of the buttonholes in the series from the first positioning so that the remaining groups 103, 104 and 105 can be used to continue the series of buttonholes. The small circles or dots 108 are placed at the ends of the holes merely to facilitate explaining or giving directions to the seamstress indicating which end of the hole is to be shortened or adjusted.

Template 116 has horizontal holes 117, 118 arranged in groups of three with an additional set of holes 119 arranged in groups of two. These sets of holes in template 116 are also used in a similar manner to that described above to guide the seamstress in sewing buttonholes on a garment to be grouped in that configuration.

Template 170 includes three groups of holes 171, 172, and 173 spaced radially in a semi-circular pattern for placement of ornamental buttonholes. There is no overlay associated with this template; therefore, the seamstress would place the buttonholes by either using all the sides of the holes as cut or by using any lesser number of adjacent sides of each hole as a guide and sewing the remaining sides by sighting relative placement of the buttonholes within the holes.

Figure 7:
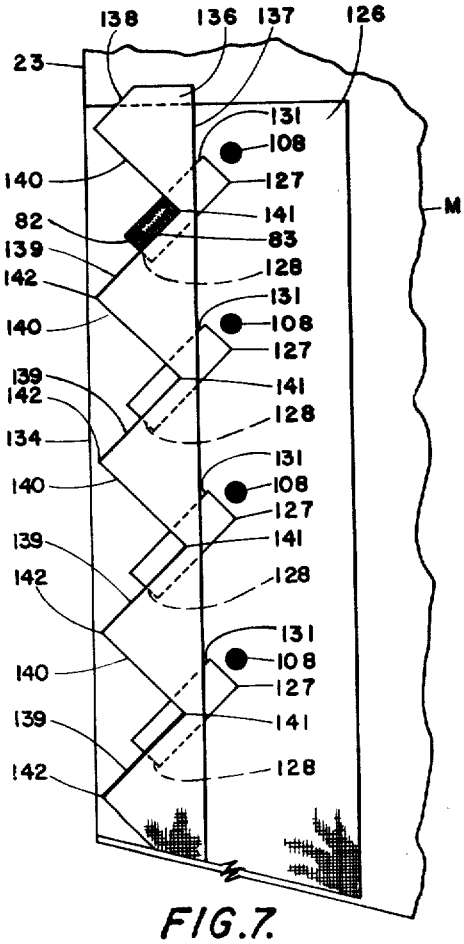
FIG. 7 is an enlarged section of a template with a series of parallel holes therethrough oriented at an angle to the edge of the template and having a triangular notched overlay for reducing two dimensions of the hole.

Template 126 includes a series of holes 127 spaced equidistant from adjacent holes, each hole being oriented with its longitudinal axis extending upwardly and to the left at an angle of 45° from the front edge 134 of the template. The overlay 136 is adapted for use in combination with template 126 for reducing the size of the holes 127 in two dimensions as shown in FIG. 7. The overlay 136 is separated from the composite sewing guide 100 by cutting along cut lines 137 and 138.

The cut line 138 is configured in a saw tooth pattern such that triangular notches with adjacent sides 139, 140 are formed therein, each of said sides being oriented normal to each other and at oppositely directed 45° angles to the cut line 137. Because the distances between adjacent apexes 141 or 142 are equal to the spacing between adjacent holes 127, this overlay 136 can be positioned over the template 126 partially covering the holes 127 to uniformly reduce their effective sizes such that the effective guide opening for the buttonhole will be formed between the first end 128 and second side 131 of hole 127 and adjacent sides 139, 140 of the overlay 136. When the overlay 136 is positioned on template 126 with its rear edge 137 parallel to the front edge 134 of template 126, each hole 127 in the series will be uniformly reduced in size to that desired for the particular buttonholes to be sewn. The buttonholes 80 are then sewn within the guide as described above.

Template 150 has holes 151 oriented similar to the holes 127 in template 126, i.e., with their longitudinal axes directed upwardly and to the left at an angle of 45° from the front edge 137. However, interspersed therebetween in alternating positions are a second set of holes 158 which are oriented with their longitudinal axes extending downwardly and to the left at an angle of 45° to the edge 137 and normal to the longitudinal axes of the holes 151. As best seen in FIG. 8, the center of each hole 151, 158 is equidistant to the center of the adjacent holes and to the distance between adjacent apexes 141 or 142 of the overlay 136 so that the same overlay 136 can also be positioned on the template 150 to uniformly reduce the effective openings of the holes 151, 158.

Simply moving the overlay 136 either left or right results in uniformly reducing or enlarging the effective openings. The guide opening for sewing the buttonhole in holes 151 is the area between the first end 152 and second side 155 of hole 151 and adjacent sides 139, 140 of overlay 136. Similarly, the effective guide opening in holes 158 is the area between first end 159 and first side 161 of the hole 158 and adjacent sides 139, 140 of the overlay 136. When the desired opening size is attained, the overlay 136 and template 150 are temporarily fastened together and positioned on the material M with the edge 134 of template 150 aligned with edge 23 of the material M. The buttonhole 80 is then sewn in the same manner as described above.

A third embodiment of the present invention is shown in FIG. 9. In this embodiment, the template 176 is formed with a perimeter conforming to the perimeter of a segment or section 178 of a garment being sewn. The guide holes 181 in the template 176 are sized and positioned on the template corresponding to the desired location, size and orientation of the buttonholes to be sewn in the garment. As will be readily apparent to one skilled in the art, the sections of a garment are commonly cut around the perimeter of a pattern of predetermined shape. The template 176 of this invention would also be shaped with a corresponding perimeter. Consequently, it is a simple matter for the seamstress to position the template 176 properly on the surface of the garment section 178 by matching the unique contours, curves and edges to the garment section 178. The template 176 would then be temporarily attached to the garment section 178 by pins or tack stitching and the buttonholes 80 could be stitched within the boundaries of the template holes 181 with a zig-zag sewing machine.

If the pattern or template manufacturer wishes to leave some discretion for the size of the buttons and buttonholes to be used on the garment, it could simply provide an overlay similar to the overlays described in the first and second embodiments so that the seamstress could adjust the effective size of the openings before sewing the buttonholes.

The buttonhole sewing guides described above can also be used for making and placing bound buttonholes. To do so, the seamstress would first choose the desired template for the orientation and spacing of the buttonholes required and would adjust the size of the guide openings to fit the button by positioning the overlay over the template as described above. Then a strip of interfacing such as organza interfacing or self-fabric is prepared with dimensions two inches wider than the length of the opening in the guide and three inches longer than the total span of the combined series of buttonholes. Adhesive is applied or sprayed on one side of the strip of organza, and the strip is then laid over the area where the buttonholes will be positioned on the right or exposed side of the garment. The template is then placed over the organza strip and placed in the desired position so that at least one inch of organza extends beyond each end of the proposed bound buttonhole. The template is then temporarily secured to the garment over the organza strip.

Small stitches, approximately 16–18 per inch are sewn within the perimeters of the openings in the guide. The guide is then removed and the organza is cut along the midspan of the longitudinal axis of the buttonhole and then slit from the ends of the longitudinal slit at 45° angles into the corners of the buttonhole. The organza is then cut between adjacent buttonholes to form individual segments of organza that are then turned through each buttonhole, respectively, from the exposed side of the garment to the under or wrong side and is stretched and pressed so that none of the organza shows on the exposed side of the garment.

A butterfly strip is then prepared by cutting two strips of fabric (the same fabric from which the garment is made) approximately one and a half inches wide and two and one-half times the combined length of all the buttonholes in the series. With the exposed side of the fabric placed together, these strips of fabric are basted with the sewing machine down their centers. The strips are then spread open and pressed flat at the seam.

The butterfly strip is then cut into segments, each of which is approximately twice the length of each buttonhole. The butterfly strip is then laid on the under side of the buttonhole and the seam is carefully centered and basted into that position, or an iron-on glue can be used iron-on glue can be used between the butterfly strip and the organza facing. The stitches are then hidden by turning them to the inside of the garment and separating the seam edges from the garment and butterflies. The seamstress then stitches around the opening on the same stitch lines as before, stitching the long first and then across the ends. The excess organza on the inside of the garment is then trimmed close to the buttonhole and is also trimmed about one-half inch away from the top stitch line. The buttonhole can then be pressed and finished in the customary manner.

Although the present invention has been described with a certain degree of particularity, it is understood that the present disclosure has been made by way of example and that changes in details of structure may be made without departing from the spirit thereof.

What is claimed is:

1. A buttonhole sewing guide for sewing buttonholes in fabric, comprising:

a thin, flexible template having a lateral edge and a plurality of generally rectangular holes therethrough of a size larger than the desired buttonhole for placement on the fabric where the buttonhole is to be sewn, said holes having a common axis parallel to said lateral edge and each having a vertical length along said common axis and a horizontal length along a respective individual axis perpendicular to said common axis, and size adjustment means associated with said template selectably actuable for reducing the effective size of holes in said vertical and horizontal lengths both separately and simultaneously to correspond with the desired size of the buttonhole stitching to be sewn, the effective size of each of said holes being adjusted in a common manner.

2. The buttonhole sewing guide of claim 1, wherein said size adjustment means includes a thin, flexible overlay sheet having a plurality of aligned rectangular holes therethrough of size, shape and spacing corresponding to the size, shape and spacing of said holes through said template adapted for positioning partially over said holes through said template to reduce the effective length and width of each of said holes through said template to correspond with the desired length and width of the buttonhole stitching to be sewn.

3. The buttonhole sewing guide of claim 1, wherein said size adjustment means includes a thin, flexible overlay sheet having a straight lateral edge and a plurality of rectangular holes therethrough, said holes aligned along said lateral edge with one side of each said hole through said overlay being open to a lateral edge of said overlay.

4. The buttonhole sewing guide of claim 1, wherein both said template and said size adjustment means are integral parts of a single sheet of fabric having printed thereon cut lines along which said template and said size adjustment means can be separated from each other prior to use.

5. The buttonhole sewing guide of claim 1, wherein said template has a perimeter of corresponding size and configuration to the perimeter of the fabric in which the buttonholes are to be sewn.

6. The buttonhole sewing guide of claim 1 wherein said rectangular holes each have a top edge and a bottom edge which intersect said common axis and a left edge and a right edge which intersect its respective perpendicular axis, and said size adjustment means is adapted to mask any one of said edges on each of said buttonholes to reduce the effective size thereof and selectively actuable to mask any pair of adjacent edges on each of said buttonholes to reduce the effective size thereof.

7. The buttonhole sewing guide of claim 1 wherein said vertical length is at least twice as large as said horizontal length.

8. A buttonhole sewing guide adapted for sewing buttonholes in fabric, comprising a thin, flexible material having printed thereon horizontal and vertical outlines marking locations for a plurality of holes to be cut therethrough at predetermined spacing and orientation for forming a template adaptable for positioning on an article being sewn to mark the desired spacing and orientation for buttonholes to be sewn in the article, said material also including an overlay portion of predetermined size, configuration and spacing having marking locations corresponding to said outlines marking the template holes and adapted to uniformly reduce in two dimensions the effective sizes of said template holes when said overlay holes are cut out and said overlay is positioned over said template, there being cut lines printed on said material along which said template and said overlay can be separated from each other consistent with said predetermined size, configuration, and spacing prior to use in sewing buttonholes.

9. A buttonhole sewing guide for sewing buttonholes in fabric, comprising:

a template having a straight lateral edge and at least one generally rectangular hole therethrough at a spaced distance from said lateral edge, said hole oriented with its longitudinal axis at an acute angle to said lateral edge, and size adjustment means associated with said template for reducing the effective size of said hole to correspond with the desired size of the buttonhole stitching to be sewn, said size adjustment means including a flexible overlay sheet having a lateral edge with a notch in the form of a right-angle cut therein adapted for positioning partially over said hole to reduce its effective length and width to correspond with the desired length and width of the buttonhole stitching to be sewn.

10. The buttonhole sewing guide of claim 9 wherein said template includes a plurality of said holes all being spaced equidistant from said straight lateral edge, the space between adjacent of said holes being equal, and each of said holes being similarly oriented with their respective longitudinal axes at equal angles to said straight lateral edge, and wherein said overlay sheet has a plurality of said right-angle notches cut in the lateral edge of said overlay such that one side of each notch is oriented at an acute angle to said lateral edge of said overlay equal to the acute angle between said straight lateral edge of said template and the longitudinal axis of said holes, and the distance between adjacent of said one sides of said notches being equal to the distance between said holes in said template, whereby positioning said notches of said overlay over portions of corresponding of said holes in said template uniformly reduces the length and width dimensions of each of said holes to the desired size of the stitching for a series of space-apart buttonholes to be sewn.

11. The buttonhole sewing guide of claim 9, wherein said template includes a plurality of said holes all being spaced equidistant from said straight lateral edge, the space between the respective centers of adjacent of said holes being equal, and both the transverse and longitudinal axes of each hole being at right angles to each other as well as at 45° angles to said straight lateral edge, said holes also being alternatingly oriented such that the transverse axis of each hole is parallel to the longitudinal axis of the next adjacent hole, and wherein said overlay sheet has a plurality of said right angle notches cut in the lateral edge of said overlay such that both sides of each notch is at a 45° angle to said lateral edge of said overlay, and the distance between the apex of adjacent notches being equal to the distance between the centers of adjacent of said holes in said template, whereby positioning said notches of said overlay over portions of corresponding of said holes in said template uniformly reduces the length and width dimensions of each of said holes to the desired size of the stitching for a series of spaced-apart buttonholes to be sewn.

* * * * *